US007293854B2

(12) United States Patent
Isono et al.

(10) Patent No.: US 7,293,854 B2
(45) **Date of Patent: *Nov. 13, 2007**

(54) INK JET HEAD

(75) Inventors: Hitoshi Isono, Tenri (JP); Takeshi Yaneda, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 32 days.

This patent is subject to a terminal disclaimer.

(21) Appl. No.: 10/495,205

(22) PCT Filed: Jan. 23, 2003

(86) PCT No.: PCT/JP03/00620

§ 371 (c)(1),
(2), (4) Date: May 10, 2004

(87) PCT Pub. No.: WO03/064160

PCT Pub. Date: Aug. 7, 2003

(65) Prior Publication Data

US 2005/0001885 A1 Jan. 6, 2005

(30) Foreign Application Priority Data

Jan. 29, 2002 (JP) ..... 2002-019699

(51) Int. Cl.
*B41J 2/14* (2006.01)
*B41J 2/045* (2006.01)

(52) U.S. Cl. ..... 347/50; 347/69

(58) Field of Classification Search ..... 347/50, 347/68, 69; 29/25.35
See application file for complete search history.

(56) References Cited

U.S. PATENT DOCUMENTS 5,631,680 A * 5/1997 Sugahara ..... 347/69
5,646,661 A * 7/1997 Asai et al. ..... 347/69
5,984,447 A * 11/1999 Ohashi ..... 347/9
6,513,916 B2 2/2003 Isono et al. ..... 347/68
6,547,375 B2 4/2003 Isono et al. ..... 347/69
7,156,503 B2 * 1/2007 Isono et al. ..... 347/69
2001/0055049 A1 12/2001 Isono et al.

FOREIGN PATENT DOCUMENTS

| | | |
|---|---|---|
| JP | 07-186382 | 7/1995 |
| JP | 07-186383 | 7/1995 |
| JP | 9-94954 | 4/1997 |
| JP | 10-264382 | 10/1998 |
| JP | 2002-301823 | 10/2002 |
| JP | 2003-072062 | 3/2003 |
| JP | 2003-080697 | 3/2003 |

* cited by examiner

*Primary Examiner*—An H. Do
(74) *Attorney, Agent, or Firm*—David G. Conlin; David A. Tucker; Edwards Angell Palmer & Dodge LLP

(57) ABSTRACT

An ink jet head includes a base with front and rear ends having a plurality of channel grooves separated by channel walls each including a piezoelectric extending to the rear end, a cover that is placed on the base to be in contact therewith and opposite to the face of the base that has the channel grooves, electrodes placed on at least part of the inner surface of each one of the channel grooves, a conductive resin electrically connected with the electrode plugging up each of the channel grooves at the rear end, and projections as a pressing means for pressing the top of the conductive resin at the rear end of each channel groove.

12 Claims, 11 Drawing Sheets

INK JET HEAD

TECHNICAL FIELD

The present invention relates to an ink jet head for printers and the like. More particularly, the present invention relates to an ink jet head where ink contained within an ink chamber defined by walls including a piezoelectric member is ejected by applying a voltage to the piezoelectric member to deform it and thereby produce a pressure vibration in the ink chamber.

BACKGROUND ART

Recently, in the field of printers, impact printers have been rapidly replaced by non-impact printers such as ink jet printers, which can more easily be adapted to color printing and multiple gradations. Among ink jet heads used for ejecting ink in this connection, those of drop on demand type where only droplets required for printing are ejected are of particular interest because they provide a highly efficient ejection and allow an easy cost reduction. Common drop on demand printers include Kyser printers and thermal jet printers.

The Kyser printer, however, has a drawback of being difficult to be made smaller and more compact. The thermal jet printer is suitable for a more compact design. However, it requires the ink to be heat-resistant because it has a heater for heating ink to produce bubbles in the ink, whose energy is used to cause ejection. In addition, the heater cannot easily achieve a long life, and has a low energy efficiency, resulting in a large power consumption.

In order to solve their respective problems, ink jet printers have been disclosed that utilize the shear mode of the piezoelectric member. This type of printers use electrodes provided on both sides of the wall between ink channels (hereinafter referred to as "channel walls") made of a piezoelectric to produce an electric field perpendicular to the polarization of the piezoelectric, thereby deforming the channel walls by virtue of the shear mode, which causes variations of pressure wave that is used to eject ink droplets. This type of printers are suitable for producing a more compact nozzle, reducing power consumption and increasing driving frequency.

Referring to FIG. 12, the structure of such an ink jet head using the shear mode will be described. The ink jet head includes a base 1 having therein a plurality of channel grooves 4 that is made of a piezoelectric material polarized in the vertical direction in FIG. 12, a cover 2 having an ink supply port 21 and a manifold space 24, and a nozzle plate 9 with nozzle orifices 10, all of which are bonded together to provide ink channels. "Ink channels" are pressure chambers that are provided by the inner space of channel grooves 4. Each of channel walls 3 is provided with electrodes 5 on its upper half only, for allowing the application of an electric field. The side of an ink jet head with nozzle plate 9 is hereinafter referred to as "front", the opposite side as "rear". In the above ink channels, the rear end of each channel groove 4 has been machined to form an arc shape corresponding to the diameter of a dicing blade used for forming the grooves, and also has a shallow groove portion 6, which is an electrode lead portion for electrical connection with the outside and is provided by, again, a dicing blade machining. At the rear end of shallow groove portion 6, the electrode in shallow groove portion 6 is connected to an outer electrode 8 on a flexible printed board 11 via a bonding wire 7. An ink jet head with such structure is supplied with ink from manifold space 24 via the arc shaped region, where the required pressure for ejection is produced in the region in which the top of each channel wall 3 in base 1 is bonded to cover 2. The arc shaped region is not used and yet adds capacitance.

An ink jet head without an arc shaped region for decreasing capacitance is disclosed in Japanese Patent Laying-Open No. 9-94954. The disclosed ink jet head, however, has a connection on the bottom surface of the base board for connecting the electrodes on the channel walls to the outside, requiring a complicated process to provide connecting electrodes.

Thus, ink jet heads with decreased capacitance and with an easier connection of the electrodes on the channel walls to the outside are proposed as shown in FIGS. 13 and 14. FIG. 13 is an exploded perspective view of such an ink jet head. FIG. 14 is a cross sectional view of the assembly thereof The ink jet head is characterized by channel grooves 4 that penetrate from the front end to the rear end of base 1 with a constant depth. This structure does not have an arc shaped region such that the capacitance is decreased. Also, the amount of piezoelectric material used can be reduced. Close to the rear end of each channel groove 4, channel groove 4 is sealed by a conductive resin 26 to provide an electrical connection such that those electrodes 5 that face the same one of channel grooves 4 are maintained at the same potential. Conductive resin 26 extends to the rear end of its respective channel groove 4, and the rear end of base 1 is connected to a flexible printed board 11 with an interposed anisotropic conductive film (hereinafter referred to as an "ACF") 12. An outer electrode 8 on the surface of flexible printed board 11 is electrically connected to conductive resin 26 by sandwiching ACF 12 therebetween and pressing it in the direction of its thickness. Nevertheless, the properties of ACF 12 keep each ink channel to be electrically independent.

In general, an ACF need to be pinched with a pressure greater than a predetermined level in the direction of its depth in order to establish electrical connection. In the ink jet head described above, an outer electrode 8 is electrically connected to a conductive resin 26 by pinched ACF 12. In reality, although channel groove 4 is plugged with conductive resin 26, the top of each channel groove 4 is open even at the rear end of channel groove 4 such that pinching ACF 12 and pressing flexible printed board 11 onto base 1 causes conductive resin 26 to move away toward the front. This may prevent conductive resin 26 from pressing ACF 12 with a sufficient pressure, resulting in increased electrical resistance between conductive resin 26 and outer electrode 8, which should be electrically connected to each other, or in unstable connection.

Moreover, conductive resin 26 has a coefficient of linear expansion greater than that of piezoelectric materials used for base 1. As a result, a variation in temperature may produce a crack between a conductive resin 26 and a channel wall 3 adjacent thereto.

DISCLOSURE OF THE INVENTION

An object of the present invention is to provide an ink jet head that ensures electrical connection at the rear end of each channel groove via an ACF, and prevents a crack from being produced between the conductive resin and the channel wall even when the temperature changes.

To achieve the above object, an ink jet head according to the present invention includes a base with front and rear ends, having a plurality of channel grooves that are separated by a channel wall including a piezoelectric material and that extend to the rear end, a cover placed on the base to be in contact therewith, being opposite to the face of the base that has the plurality of channel grooves, an electrode placed on at least part of the inner surface of each one of the channel grooves, a conductive resin plugging up the channel groove at the rear end, and a pressing means for pressing the top of the conductive resin at the rear end. This arrangement allows the conductive resin within each channel groove to be pressed by the pressing means, thereby preventing the conductive resin from moving within the channel. Thus, during establishing electrical connection of the rear end of the ink jet head to other components via the conductive resin, the conductive resin can be prevented from moving away, ensuring electrical connection.

Preferably, the invention further includes an anisotropic conductive film in contact with the rear end of the base, and a circuit board in contact with the rear end with the anisotropic conductive film interposed therebetween. This arrangement requires the step of pinching and pressing an anisotropic conductive film between the rear end of the ink jet head and the circuit board during assembly. It provides, however, a more reliable electrical connection since the conductive resin within each channel groove can be pressed by the pressing means to prevent the conductive resin from moving away when the anisotropic conductive film is pressed, and to apply a sufficient pressure to the film.

Preferably, the pressing means according to the invention is a projection provided on the cover. This arrangement implements the pressing means using a part of the existent components instead of using an additional component.

Preferably, the plurality of channel grooves according to the invention are disposed with a given channel groove pitch, and a plurality of projections are disposed with the same pitch as the channel groove pitch. This arrangement allows each of the projections to be opposite to the respective channel in the same fashion by properly aligning the cover with the base. Even when a misalignment occurs, variations of ejection properties for different ink channels can be removed because all the projections are misaligned with the respective channel grooves in a similar fashion such that all the ink channels have equal properties.

Preferably, the plurality of channel grooves according to the invention are disposed with a given channel groove pitch, and the projection has a tip surface that is bonded to the top of the conductive resin and the top surface of a channel wall. The tip surface has a length perpendicular to the longitudinal direction of the channel grooves that is greater than the width of one channel groove and is smaller than the channel groove pitch. This arrangement allows the tip surface of each projection to completely block one channel, thereby pressing the conductive resin in the channel groove with a sufficient force.

Preferably, the plurality of channel grooves according to the invention are disposed with a given channel groove pitch, and a plurality of projections are disposed with a pitch that is determined by multiplying the channel groove pitch by an integer. This arrangement allows the bonding of a plurality of pieces of the conductive resin within the respective channel grooves and a plurality channel walls in their respective top surfaces. As a result, the conductive resin can be restrained more firmly.

Preferably, the plurality of channel grooves according to the invention are disposed with a given channel groove pitch, and the projection has a tip surface that is bonded with the top of the conductive resin and the top surface of the channel wall. The tip surface has a length perpendicular to the longitudinal direction of the channel grooves that is larger than the sum of the pitch with which the plurality of channel grooves are disposed and the width of one channel, and is smaller than double the pitch for the plurality of channel grooves. This arrangement allows one projection to be bonded to three consecutive channel walls. In this way, those ink channels that are adjacent to each other are disposed symmetrically, such that all the ink channels have equal ejection properties, thereby eliminating variations of ejection properties for different ink channels.

Preferably, the projection according to the invention has a side facing the front end that is inclined toward the base. This arrangement provides a smooth flow of ink at a corner of the projection, preventing air bubbles to remain at the corner. Thus, a stable ejection of ink can be realized.

Preferably, the pressing means according to the invention is a beam fixed on the top surface of the base. This arrangement allows the conductive resin to be restrained firmly within each channel. Further, compared to the projection, the beam requires less precision in positioning in the direction of the width of the ink channels.

Preferably, the beam according to the invention has a side facing the front end that is inclined toward the cover. This arrangement provides a smooth flow of ink at a front corner of the beam, preventing air bubbles to remain at the corner. Thus, a stable ejection of ink can be realized.

Preferably, the material of the beam of the invention is the same as that of the base. This arrangement results in a coefficient of linear expansion of the beam that is the same as that of the base, preventing a crack between the beam and the base. Moreover, the use of the same material provides a stable electrical connection because, when the beam and the base are combined and cut altogether to provide a surface for electrical connection, the section has little irregularity as the same material is used from top to bottom.

Preferably, the beam according to the invention has a coefficient of linear expansion that is smaller than that of the base. Using this arrangement, when the conductive resin is expanded or contracted due to varying temperatures, the beam works in a direction to restrain deformation of the base due to its expansion or contraction, effectively preventing a crack between the conductive resin and the channel.

BEST MODES FOR CARRYING OUT THE INVENTION

First Embodiment

Figure 1:
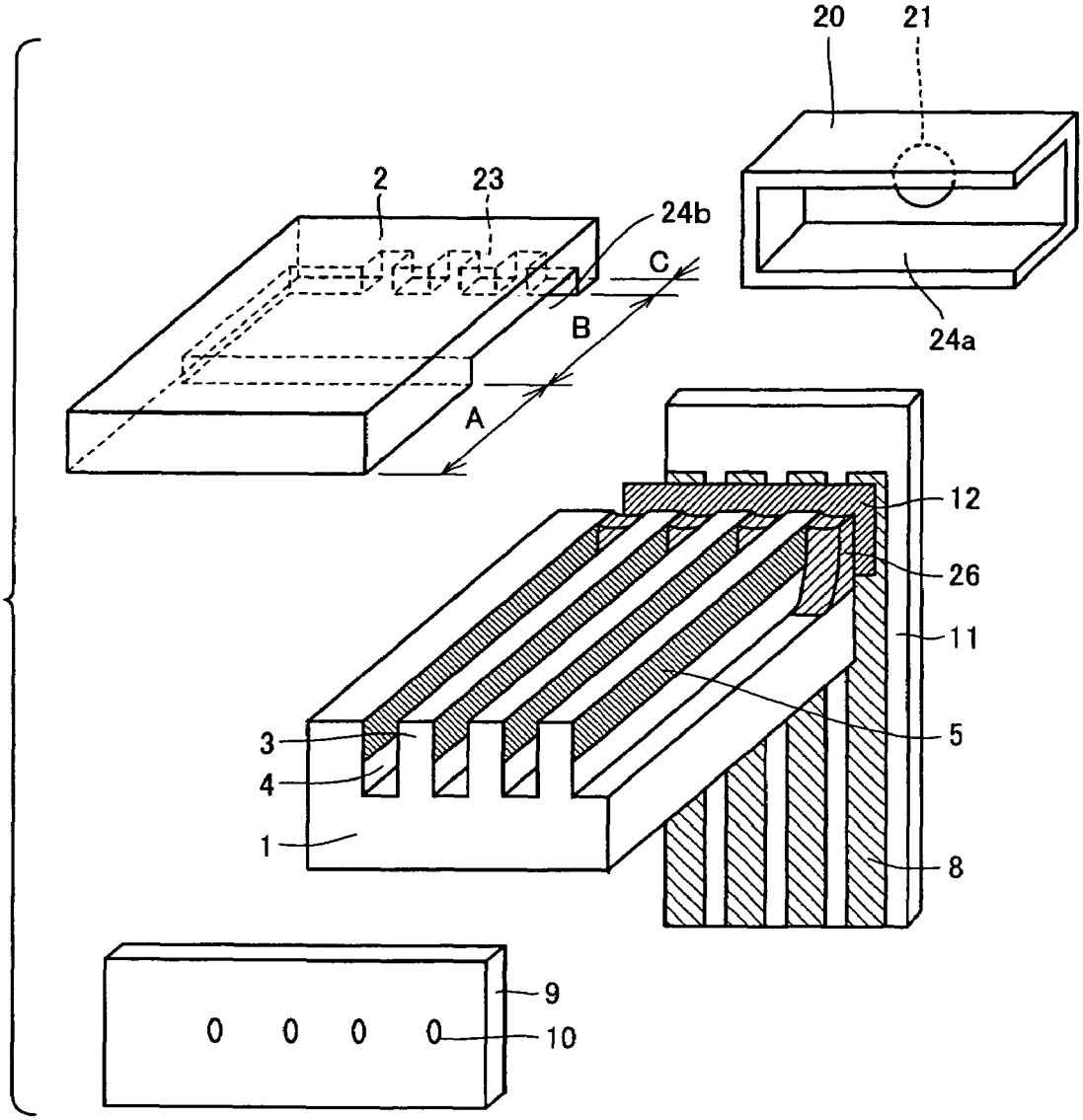
FIG. 1 is an exploded perspective view of an ink jet head according to a first embodiment of the present invention.
Figure 13:
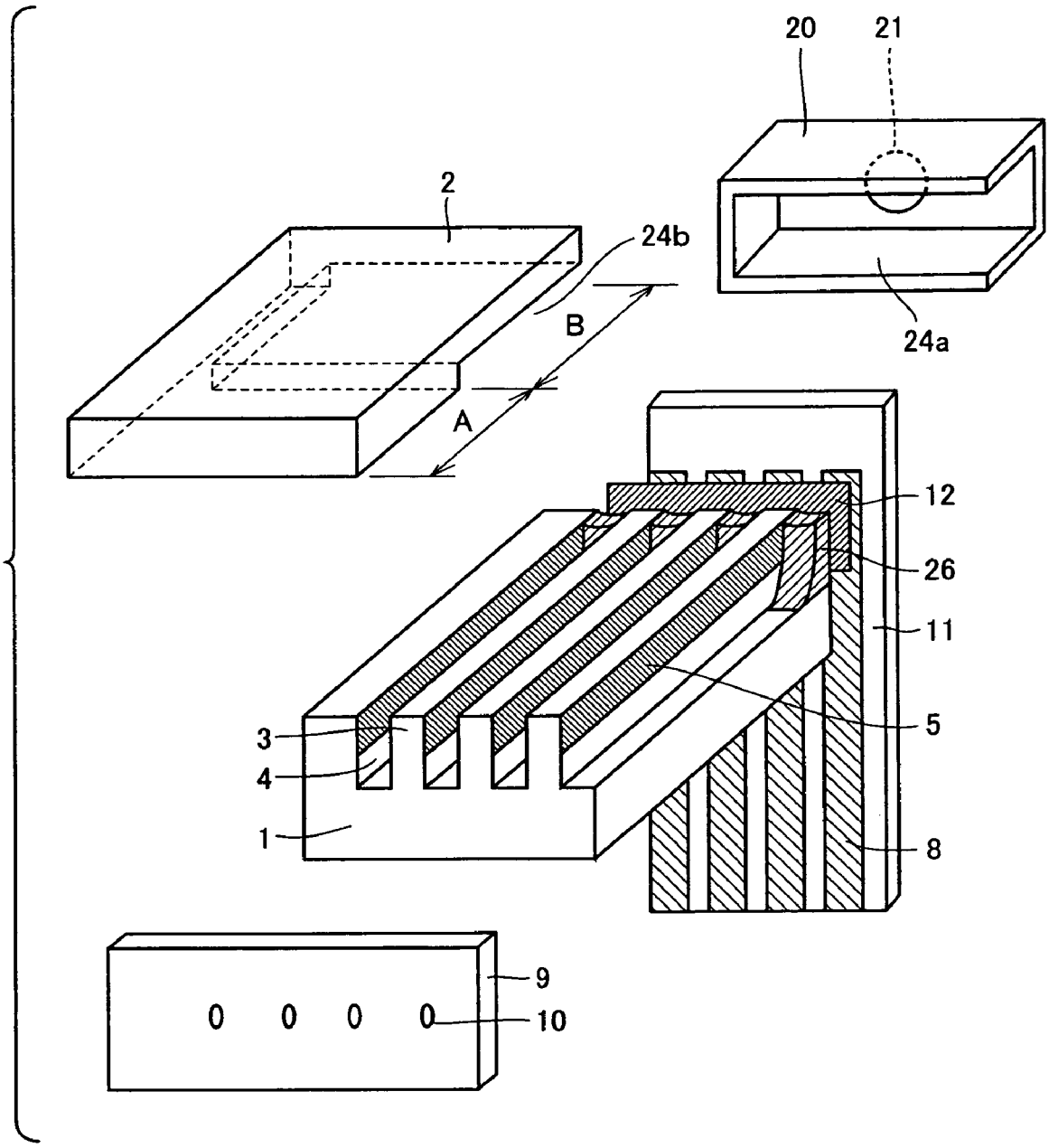
FIG.13 PRIOR ART
Figure 14:
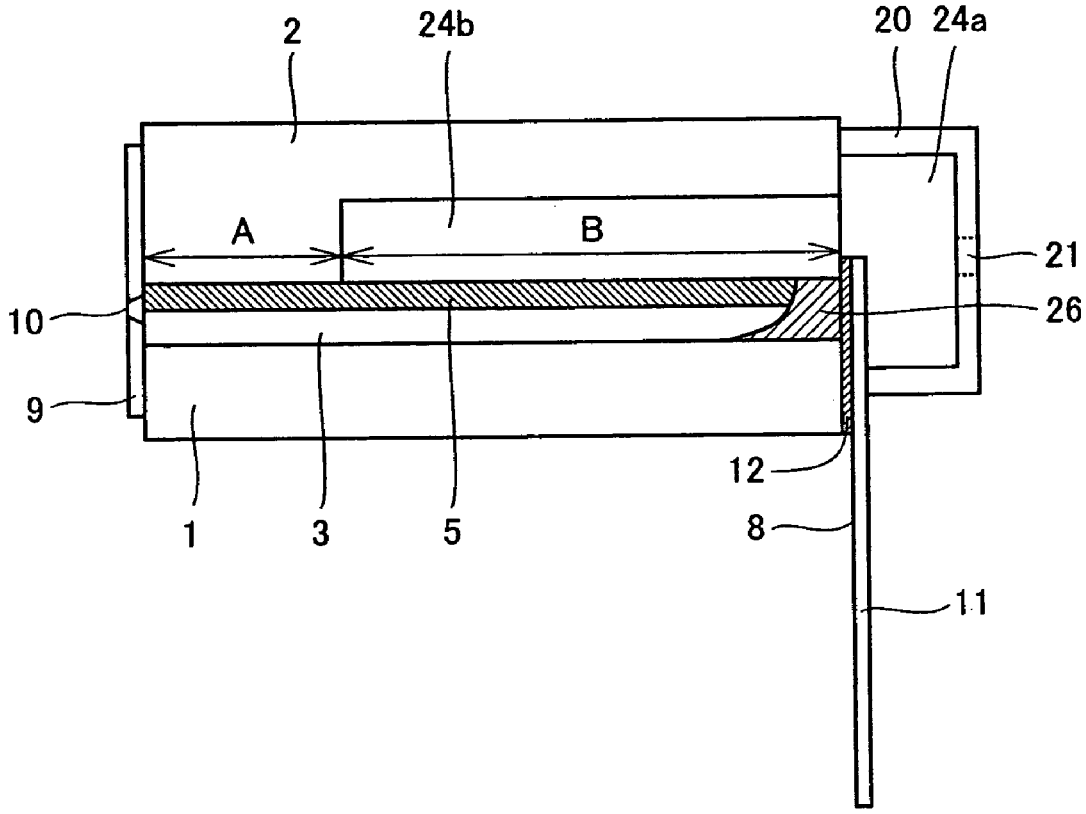
FIG.14 PRIOR ART
FIG. 14 is a cross sectional view of the second conventional ink jet head cut along a plane parallel to the longitudinal direction of the ink channels.

The structure of an ink jet head according to a first embodiment of the invention will be described with reference to FIGS. 1 to 3. As shown in FIG. 1, the ink jet head has a structure that is basically the same as those in FIGS. 13 and 14 except for a plurality of projections 23 each located in a position on cover 2 that is opposite to the rear end of a channel groove 4. Projections 23 are provided independently of each other and each in a position that corresponds to one of channel grooves 4 in base 1.

Figure 2:
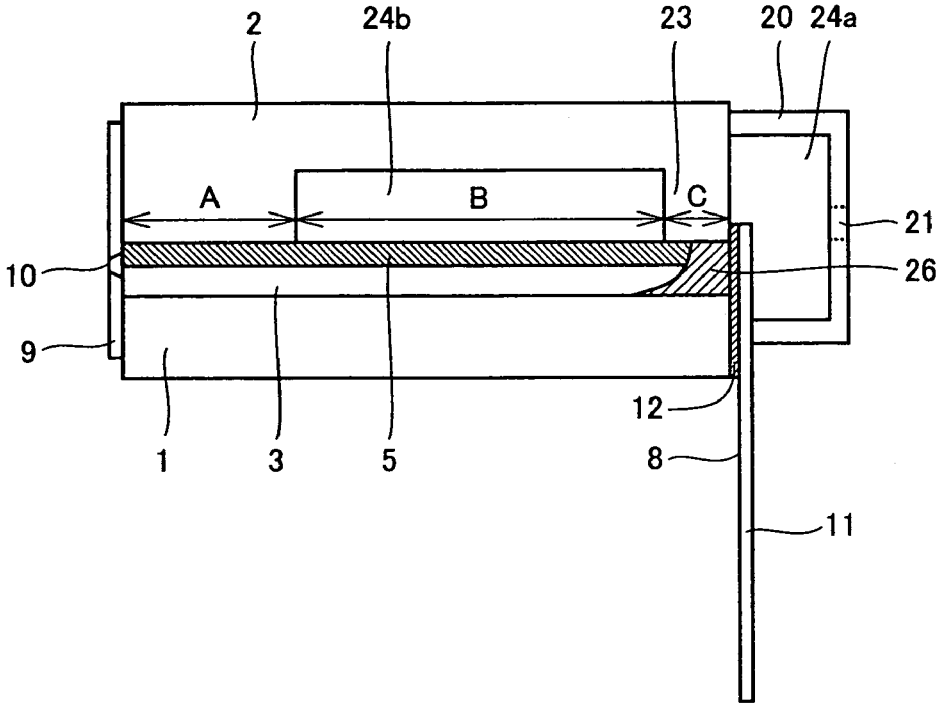
FIG. 2 is a cross sectional view of the ink jet head of the first embodiment cut along a plane parallel to the longitudinal direction of the ink channels.

FIG. 2 is a cross sectional view of the above ink jet head cut along a plane parallel to the longitudinal direction of the ink channels. As shown in FIG. 2, the ink jet head can be divided into a first region i.e. region A, a second region i.e. region B and a third region i.e. region C. Region B is where the top of each channel groove 4 is open to provide manifold space 24*b*, and region C is the region with projection 23 protruding. FIG. 3 shows a cross section of the ink jet head cut along a plane within region C perpendicular to the longitudinal direction of the channels. As shown in FIG. 3, tip surface 23*b* of projection 23 faces one of channel grooves 4, and the top surface of conductive resin 26 plugging each channel groove 4 is pressed by one tip surface 23*b*. Thus, referring to FIG. 2, ink supplied through ink supply port 21 is passed through manifold space 24*a* and gaps between projections 23 into manifold space 24*b* before being supplied to channel grooves 4. When a voltage is applied to channel wall 3 via electrode 5, channel wall 3 is deformed in region A due to the shear mode such that the ink contained in region A of channel groove 4 is ejected through nozzle orifice 10.

Specific dimensions of the parts of the above ink jet head and a method for manufacturing it are provided below. Channel groove 4 has a depth of 300 μm, a width of 77 μm and a pitch of 169 μm. The length of region A is 1.1 mm, that of region B is 2.0 mm and that of region C is 0.5 mm. The length of the top surface of conductive resin 26 in the longitudinal direction of channel groove 4 is 0.3 mm. Projection 23 provided on cover 2 has a width of 82 μm, a pitch of 169 μm, a length of 0.5 mm, and a height of 300 μm. Thus, tip surface 23*b* of projection 23 has a greater width than channel groove 4.

Electrode 5 is made of aluminum and formed by oblique deposition and has a thickness of 1.0 μm. Other conductive materials such as Cu, Ni, Ti or the like may be used for electrode 5.

Nozzle plate 9 is made of a polyimide film with a thickness of 50 μm, and nozzle orifices 10 are provided using excimer laser treatments. Instead of polyimide films, polyethylene polymer resin films may be used for nozzle plate 9. Alternatively, nozzle orifices 10 may be punched in a metal plate such as a stainless steel plate.

Conductive resin 26 is placed within channel groove 4 close to its rear end, and an ACF (anisotropic conductive film) 12 is used to connect outer electrode 8 to conductive resin 26.

In the ink jet head of the present embodiment, cover 2 is an unpolarized piezoelectric board that is provided with a manifold space 24*b* and projections 23 using sandblast treatments. Instead of an unpolarized piezoelectric board, a ceramic board may be used for cover 2. Manifold space 24*b* and projections 23 may also be formed by milling or molding.

During assembly, a conductive resin 26 is placed in an appropriate position within each channel groove 4 in base 1, then bonded with cover 2 and cut altogether in a position where conductive resin 26 is present, to provide a rear end surface. As a result, base 1, cover 2 and conductive resin 26 have a coplanar rear end surface.

Figure 3:
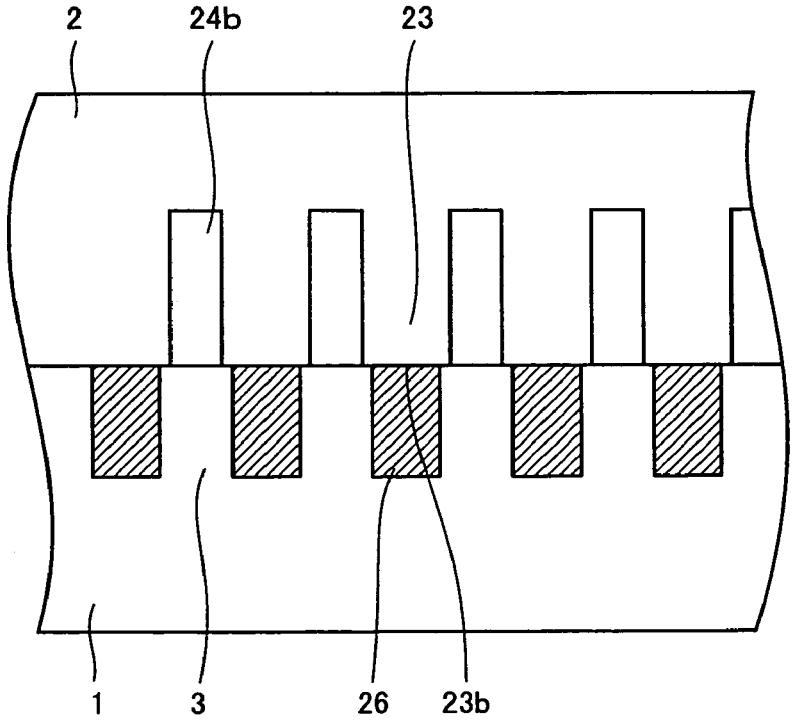
FIG. 3 is a cross sectional view of the ink jet head of the first embodiment cut along a plane perpendicular to the longitudinal direction of the ink channels.

In the ink jet head of the present embodiment, as shown in FIG. 3, tip surface 23*b* of each projection 23 presses the top surface of a conductive resin 26 plugging channel groove 4, which is conventionally open as opposite to the three other surfaces i.e. the bottom and both sides of the channel groove defined by base 1. Accordingly, conductive resin 26, when it is about to move within channel groove 4, is not only restrained from moving and spilling out of channel groove 4, but also from moving in the longitudinal direction of channel groove 4 due to the friction with the surfaces. Thus, during assembly of the ink jet head, base 1 with a conductive resin 26 plugging each channel groove 4 close to its rear end, together with flexible printed board 11, can pinch ACF 12 together to press ACF 12 for establishing electrical connection without conductive resin 26 slipping away in front of ACF 12.

Preferably, in order to ensure that a displacement of conductive resin 26 can be restrained, tip surface 23*b* of projection 23 has a width that is slightly larger than that of channel groove 4 as shown in FIG. 3, such that it completely blocks the respective channel groove 4, as seen in the cross section of FIG. 3. However, as far as a displacement of conductive resin 26 can be restrained, projection 23 is not limited to the shape that allows complete blocking of channel groove 4 as in FIG. 3, and may be shaped to have a smaller width than channel groove 4. For example, projection 23 may have a width of approximately 60 μm in the example above.

The present ink jet head can prevent conductive resin 26 from moving away from ACF 12, as described above, such that conductive resin 26 can be pressed against ACF 12 with a sufficient force. This provides a reliable electrical connection between conductive resin 26 and outer electrode 8.

Although tip surface 23*b* of projection 23 may exhibit a certain effect by simply pressing it against conductive resin 26, it is more preferable to employ an adhesive bonding to ensure that a displacement of conductive resin 26 can be restrained. At the same time, when overlying portions of tip surface 23*b* and the top surface of channel wall 3 are bonded together, the top surface of conductive resin 26 and the top surface of channel wall 3 both will be bonded onto tip surface 23*b* of projection 23, thereby preventing a crack between conductive resin 26 and channel wall 3 when conductive resin 26 is expanded or contracted by varying temperatures.

In the present embodiment, projections 23 and channel grooves 4 are provided with an equal pitch, so that an appropriate alignment of cover 2 with respect to base 1 will allow projections 23 to be opposite to the respective channel grooves 4 in the same manner. Even when a misalignment occurs, all the projections 23 are misaligned with the respective channel grooves 4 in the same manner, such that all the ink channels will have equal properties and have no variation of ejection properties among themselves.

In the present embodiment, projection 23 has a width of 82 μm. An excessive width thereof results in an insufficient path through which ink is passed from manifold space 24*a* to manifold space 24*b* such that the supply of ink becomes difficult. Therefore, the width thereof is preferably 130 μm or less.

On the other hand, an insufficient width of projection 23 results in projection 23 being in contact with conductive resin 26 over only a small area, such that only a particular region of the top surface of conductive resin 26 is pressed by projection 23 during assembly of base 1 and cover 2, and the resulting concentration of stress may damage conductive resin 26. Thus, the projection is desired to have a width of 60 μm or more.

If region C in FIG. 2 has an insufficient length, only a particular region of the top surface of conductive resin 26 is pressed by projection 23 when bonding base 1 with cover 2, and the resulting concentration of stress may damage conductive resin 26. On the other hand, an excessive length of region C produces an undesired pressure wave within the ink channel during deformation of channel wall 3 in region C due to the shear mode. In the example described above, since the top surface of conductive resin 26, as seen in the cross section as in FIG. 2, has a length of 0.3 mm, the length of region C is 0.5 mm, although region C may preferably have a length that is 80% or more and 200% or less of the length of the top surface of conductive resin 26, when the circumstances mentioned above are taken into consideration.

Second Embodiment

Figure 4:
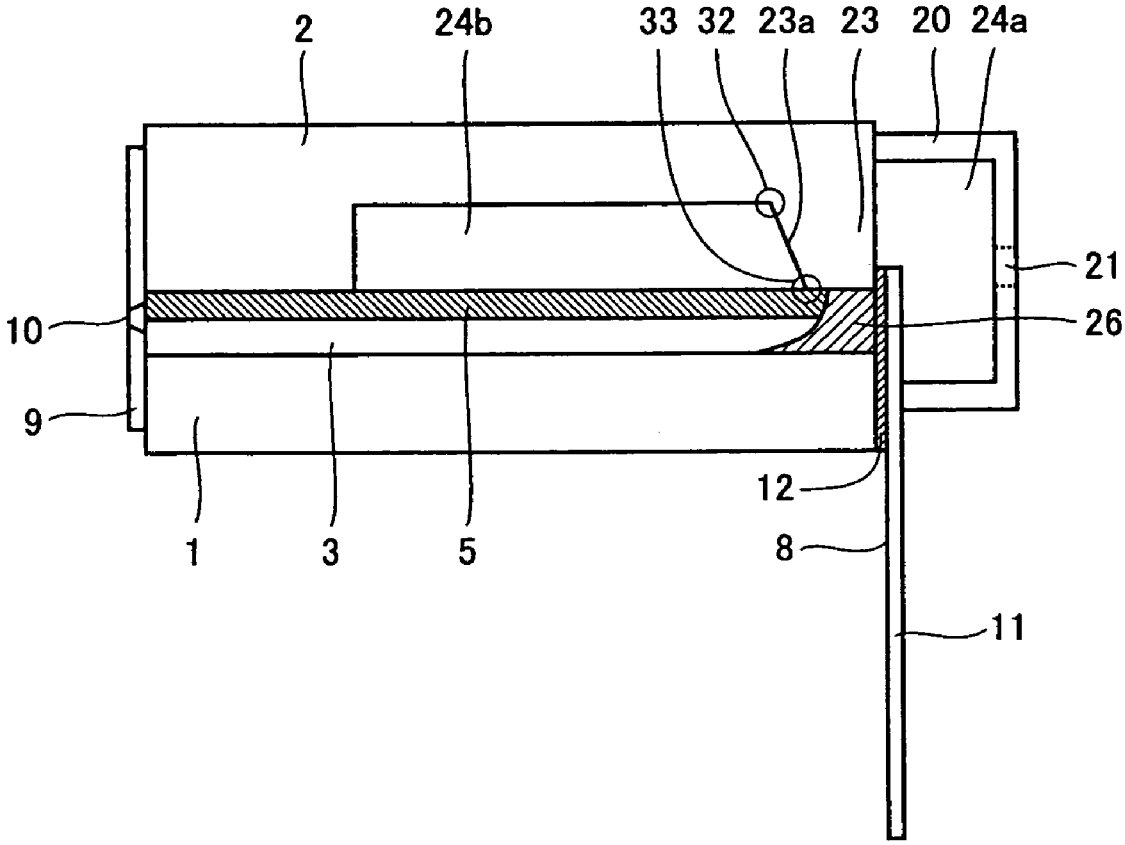
FIG. 4 is a cross sectional view of an ink jet head according to a second embodiment of the invention cut along a plane parallel to the longitudinal direction of the ink channels.

Referring to FIG. 4, the structure of an ink jet head according to a second embodiment of the present invention will be described. It has basically the same structure as the ink jet head of the first embodiment except for the shape of projection 23. Specifically, the front surface of projection 23 (i.e. the side facing nozzle plate 9) is inclined toward base 1 as shown in FIG. 4. More specifically, projection 23 has a slope 23*a* on its front side, resulting in a projection 23 that is generally trapezoidal as seen in the cross section of FIG. 4.

Since the front surface of projection 23 is slope 23*a*, ink can flow smoothly at corners 32 and 33 in FIG. 4, preventing air bubbles from remaining at corners 32 and 33. This provides a stable ejection of ink.

Third Embodiment

Figure 5:
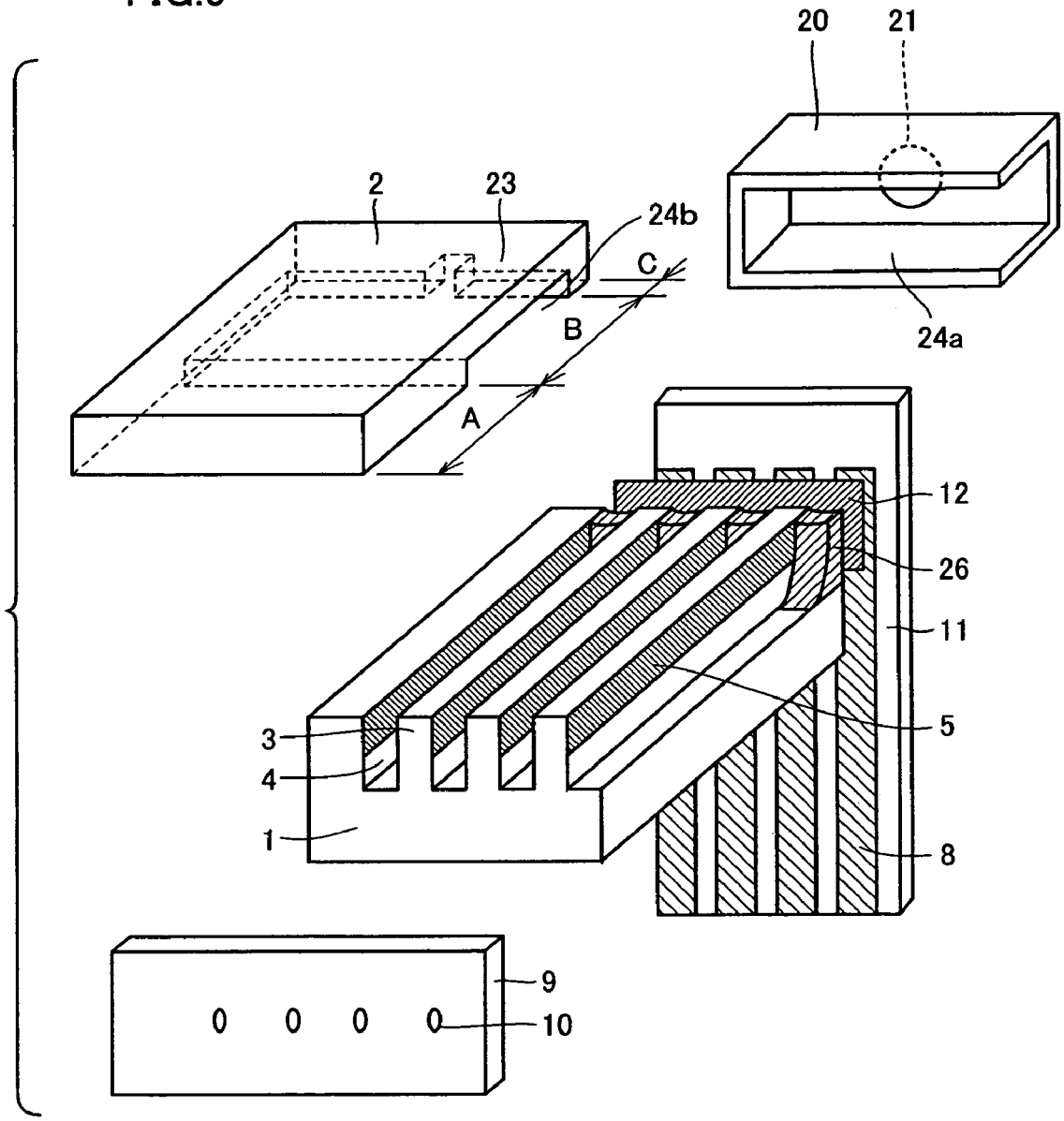
FIG. 5 is an exploded perspective view of an ink jet head according to a third embodiment of the invention.
Figure 6:
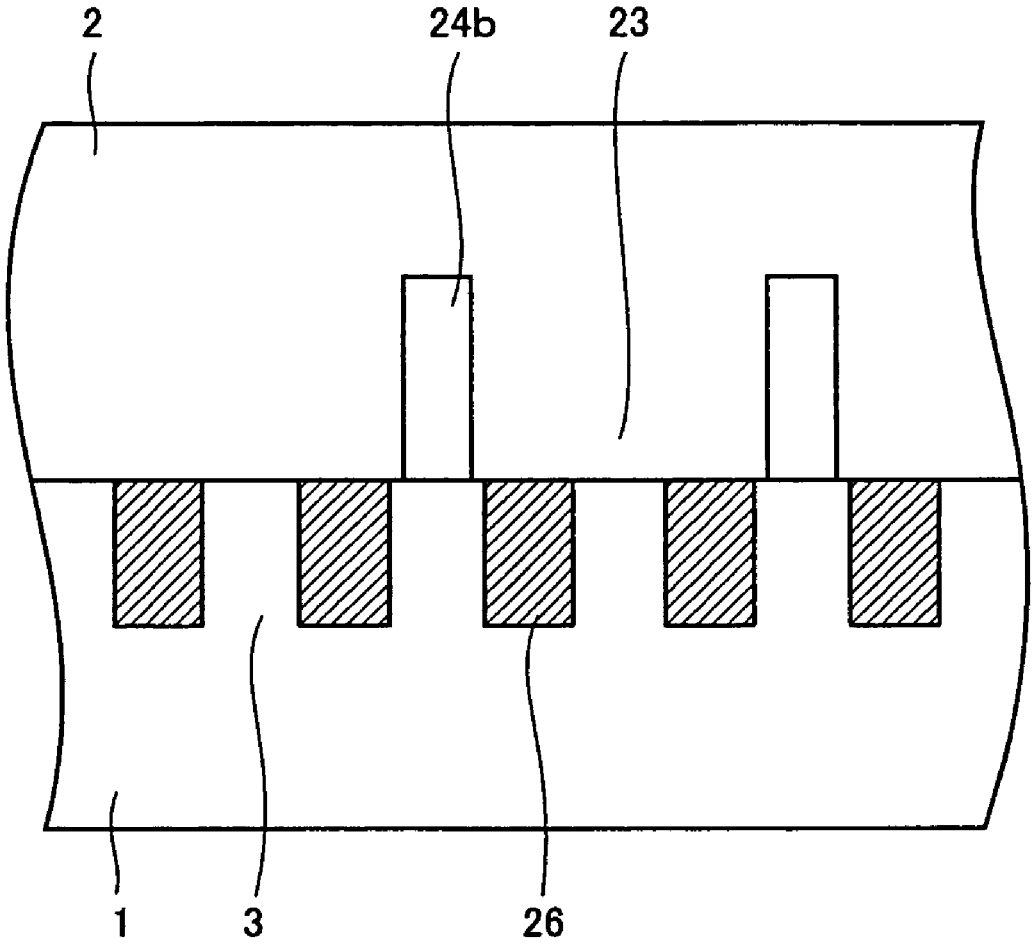
FIG. 6 is a cross sectional view of the ink jet head of the third embodiment cut along a plane perpendicular to the longitudinal direction of the ink channels.

Referring now to FIGS. 5 and 6, the structure of an ink jet head according to a third embodiment of the invention will be described. As shown in FIG. 5, it has basically the same structure as the ink jet head of the first embodiment except for the shape of projection 23. FIG. 6 is a cross sectional view of the ink jet head cut along a plane within region C perpendicular to the longitudinal direction of the ink channels. More specifically, the pitch for projections 23 is determined by multiplying the pitch for channel grooves 4 by an integer. Particularly, the pitch for projections 23 is twice as large as that for channel grooves 4 in the example of FIG. 6. Projections 23 also have an increased width corresponding to the larger pitch for projections 23, resulting in a width of each gap between projections 23 being smaller than the width of one channel wall 3.

Each projection 23 as in FIGS. 5 and 6 has a width of 251 μm (=169 μm+82 μm), a pitch of 338 μm (=169 μm×2), a length of 0.5 mm, and a height of 300 μm. In this exemplary ink jet head, projection 23 is shaped with a width that remains the same from its root to tip, such that the tip surface of projection 23 has a width that is greater than the sum of the pitch for channel grooves 4 and the width of one channel groove 4, and is smaller than double the pitch for channel grooves 4. Thus, projection 23 can bond three consecutive channel walls 3 together, as shown in FIG. 6.

It should be noted that the shape of the projection is not limited to that with a width that remains the same from its root to tip. In reality, the width of the root may be, strictly speaking, different from that of the tip for treatment reasons. It suffices if the shape and width of a projection in its entirety is determined such that the tip surface has a width that provides the required functions.

In the ink jet head of the present embodiment, projection 23 has an increased width and thus a higher rigidity. At the same time, the tip surface of projection 23 bonds a plurality of pieces of conductive resin 26 within respective channel grooves 4 in base 1 and a plurality of channel walls 3 in their respective top surfaces, such that each conductive resin 26 is more firmly restrained within channel groove 4. Thus, when ACF 12 is pinched by base 1 and flexible printed board 11 to be pressed for establishing electrical connection, a sufficient load can be applied to ensure electrical connection.

Also, since projection 23 bonds a plurality of consecutive pieces of conductive resin 26 within respective channel grooves 4 in base 1 and a plurality of channel walls 3 in their respective top surfaces, the expansion or contraction of conductive resin 26 due to varying temperatures does not cause a crack between conductive resin 26 and channel wall 3.

In the ink jet head of the present embodiment, projection 23 has a larger width so as to cover a plurality of consecutive channel grooves 4 with its tip surface. However, a greater width of projection 23 may reduce the amount of ink supplied, since the number of paths through which ink is passed from manifold space 24*a* to manifold space 24*b* is decreased, such that ink may not be ejected properly from nozzle orifices 10. Therefore, it is desirable to determine the width of a projection 23 based on the amount of ink supplied from manifold space 24*a*.

In the present embodiment, a single projection 23 bonds three consecutive channel walls 3, providing a structure with those two ink channels that are opposite to a single projection 23 being symmetrical to each other. When the pitch for projections 24 is twice as large as that for channel grooves 4, each one of projections 23 is abutted by two channel grooves 4, all in the same condition, resulting in equal ejection properties for all the ink channels, thereby eliminating variations in ejection properties for different ink channels.

Fourth Embodiment

Figure 7:
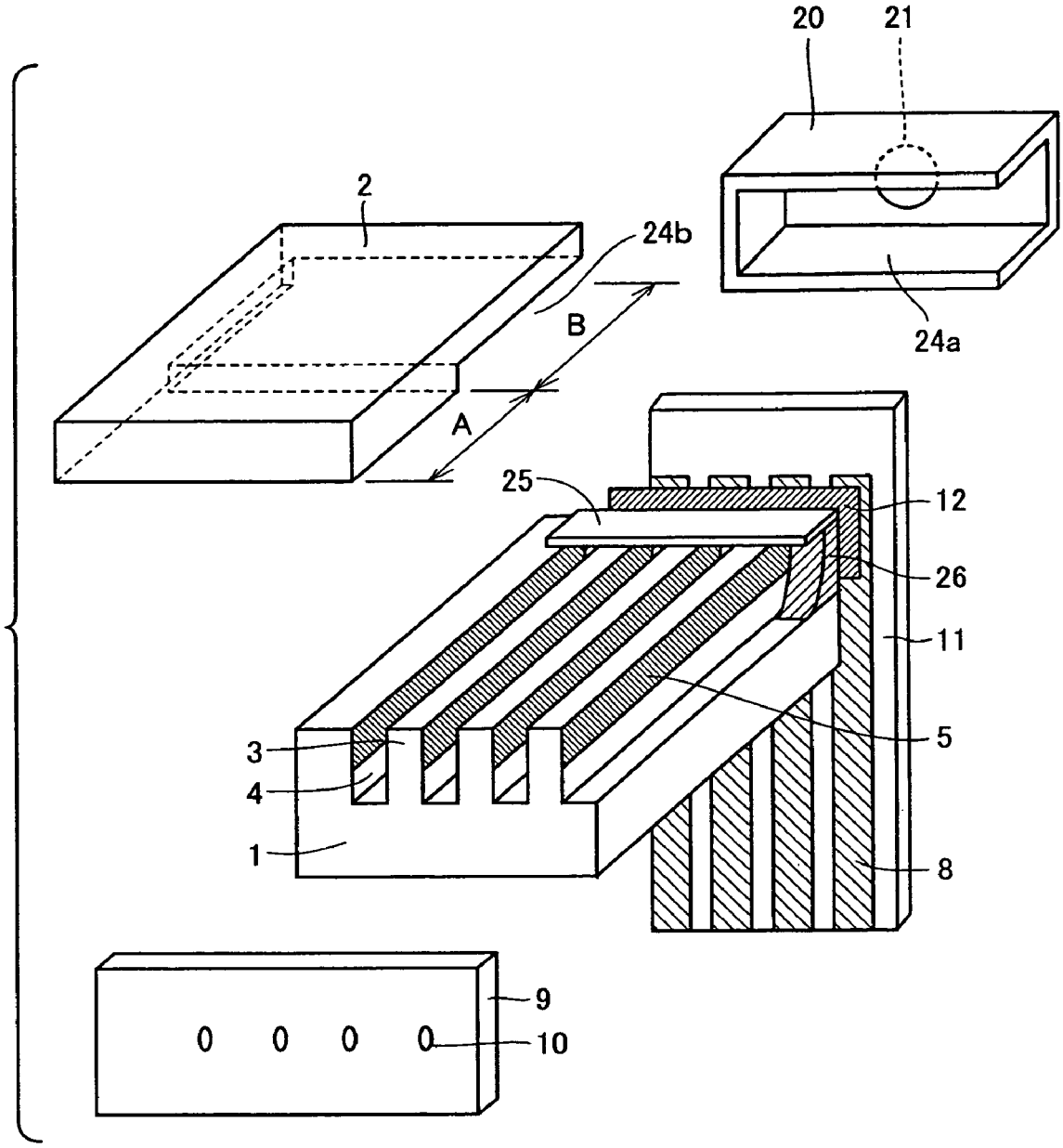
FIG. 7 is an exploded perspective view of an ink jet head according to a fourth embodiment of the invention.
Figure 8:
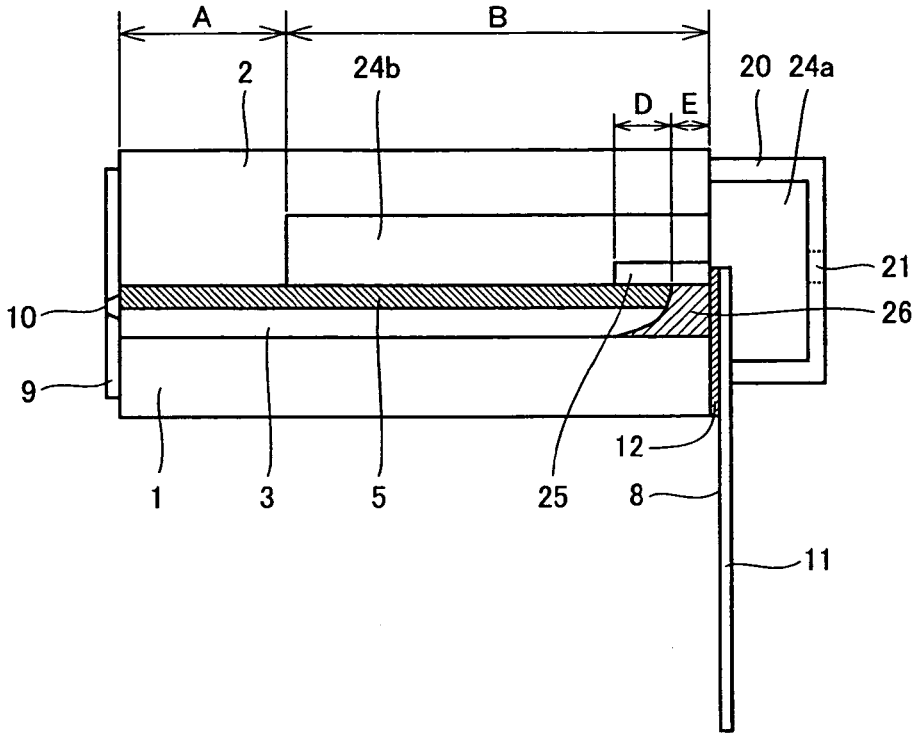
FIG. 8 is a cross sectional view of the ink jet head of the fourth embodiment cut along a plane parallel to the longitudinal direction of the ink channels.
Figure 9:
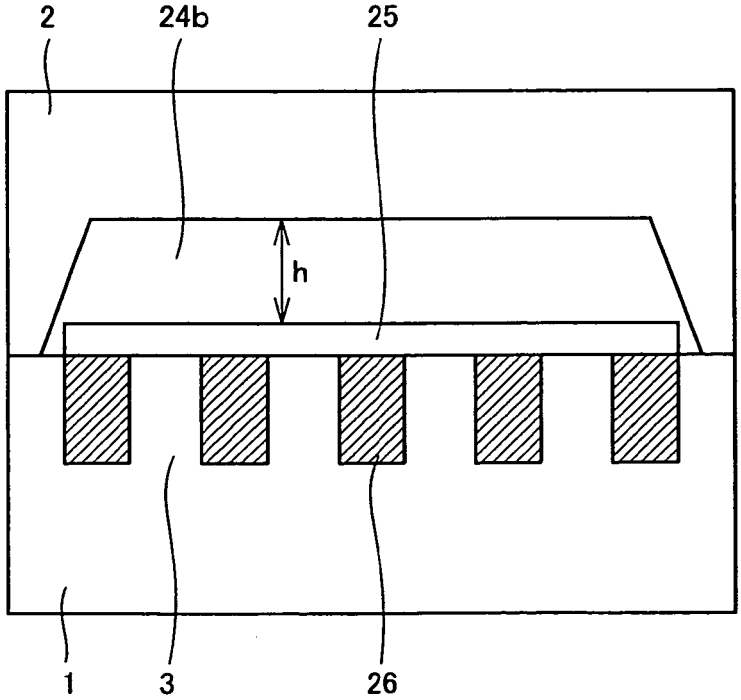
FIG. 9 is a cross sectional view of the ink jet head of the fourth embodiment cut along a plane perpendicular to the longitudinal direction of the ink channels.

Referring to FIGS. 7 to 9, the structure of an ink jet head according to a fourth embodiment of the invention will be described. As shown in FIG. 7, it has basically the same structure as the ink jet head of the first embodiment except for the provision of a beam 25 instead of projections 23 on cover 2 (see FIG. 1).

FIG. 8 is a cross sectional view of the above ink jet head cut along a plane parallel to the longitudinal direction of the ink channels. FIG. 9 is a cross sectional view of the ink jet head cut along a plane within region E perpendicular to the longitudinal direction of the ink channels.

Beam 25 is bonded to a plurality of consecutive channel walls 3 and channel grooves. Beam 25 is made of the same piezoelectric material as base 1 that has been unpolarized. Though the present embodiment uses an unpolarized piezoelectric, a polarized piezoelectric may be used.

Beam 25 is provided by treating the above piezoelectric material to a size that allows it to be contained in manifold space 24*b*. Specifically, it has a length in the longitudinal direction of channel grooves 4 (the lateral direction in FIG. 8) of 0.5 mm, and a thickness of 0.2 mm.

The ink jet head of the present embodiment has beam 25 bonded to a plurality of consecutive channel walls 3 and channel grooves such that conductive resin 26 is firmly restrained within its respective channel groove 4. Thus, when ACF 12 is pinched by base 1 and flexible printed board 11 to press ACF 12 for establishing electrical connection, a sufficient load may be applied for ensuring electrical connection.

Moreover, since beam 25 is bonded to a plurality of consecutive pieces of conductive resin 26 within respective channel grooves 4 in a base 1 and a plurality of channel walls 3 in their respective top surface, expansion or contraction of conductive resin 26 due to varying temperatures does not cause a crack between conductive resin 26 and channel wall 3.

Preferably, beam 25 is made of the same material as base 1 such that it has the same coefficient of linear expansion as base 1 to prevent a crack between beam 25 and base 1. Moreover, the use of the same material provides a stable electrical connection because, when beam 25 and base 1 are combined and cut altogether to provide a surface for electrical connection, the section has little irregularity as the same material is used from top to bottom.

Instead of using the same material for beam 25 as base 1, ceramic materials such as $Al_2O_3$ having a smaller coefficient of linear expansion than base 1 may be used. In this case, when conductive resin 26 is expanded or contracted due to varying temperatures, beam 25 works in a direction to restrain deformation of base 1 due to expansion or contraction, effectively preventing a crack between conductive resin 26 and channel wall 3.

In the present embodiment, beam 25 has a length in the longitudinal direction of channel grooves 4 of 0.5 mm. An insufficient length thereof does not enable conductive resin 26 to be firmly restrained against base 1. On the other hand, an excessive length thereof results in an increased region D, in which channel groove 4 is not plugged with conductive resin 26 and still covered with beam 25. In region D, channel walls 3 are deformed due to the shear mode, producing pressure waves. Pressure waves due to the shear mode deformation of channel walls 3 is originally intended to occur only in region A in FIG. 8, so pressure waves occurring in region D disturb a proper ink ejection. In the present embodiment, as far as the length in the lateral direction in FIG. 8 (the length in the longitudinal direction of channel grooves 4) is concerned, region E in which conductive resin 26 reaches the top end of channel groove 4 has a length of 0.3 mm, so that beam 25 has a length of 0.5 mm. The preferred length thereof ranges from 80% or more and 200% or less of the length of region E. Desirably, region D has the smallest possible length.

In the present embodiment, beam 25 has a thickness of 0.2 mm. An insufficient thickness thereof does not enable conductive resin 26 in channel groove 4 to be firmly restrained against base 1. Consequently, beam 25 is preferred to have a thickness of 0.1 mm or more. On the other hand, an excessive thickness thereof reduces the cross section of the portion through which ink can be passed from manifold space 24*a* to manifold space 24*b*, thereby reducing the amount of ink supplied and possibly preventing a proper ejection through nozzle orifices 10. Preferably, the thickness of beam 25 is determined based on its relationship with the height of manifold space 24*b* in cover 2. The height h in FIG. 9 is preferred to be 0.1 mm or more.

Furthermore, beam 25 is preferred to be bonded to all the top surfaces of the plurality of abutting channel walls 3, although beam 25 may only be bonded with some of the plurality of abutting channel walls 3 as far as the presence of beam 25 accomplishes the object of restraining a movement of conductive resin 26 within channel groove 4. For example, a single beam 25 may be bonded only with those channel walls 3 that abut its both ends.

Fifth Embodiment

Figure 10:
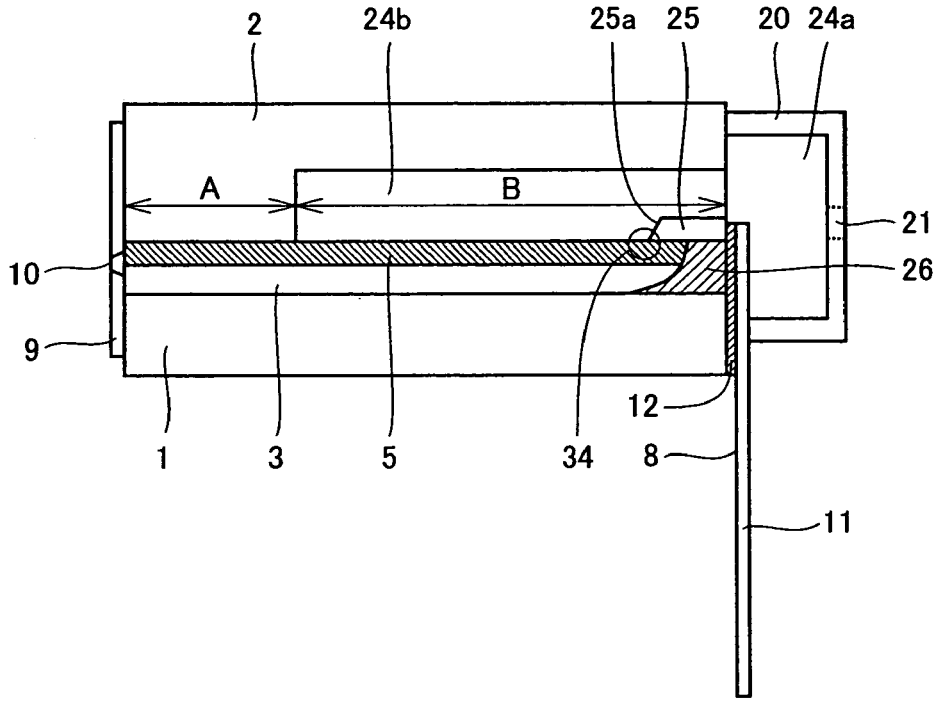
FIG. 10 is a cross sectional view of an ink jet head according to a fifth embodiment of the invention, cut along a plane parallel to the longitudinal direction of the ink channels.
Figure 11A:
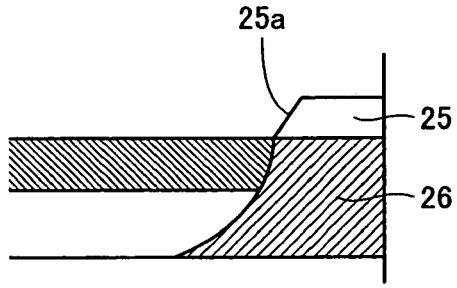
FIGS. 11A and 11B illustrate the geometry of the beam and the conductive resin of the ink jet head of the fifth embodiment.
Figure 11B:
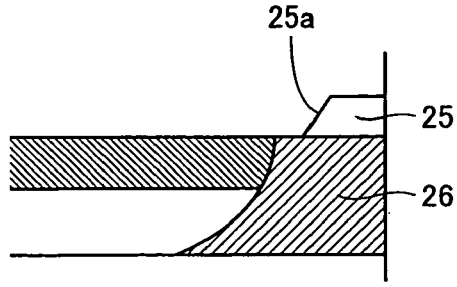
Figure 12:
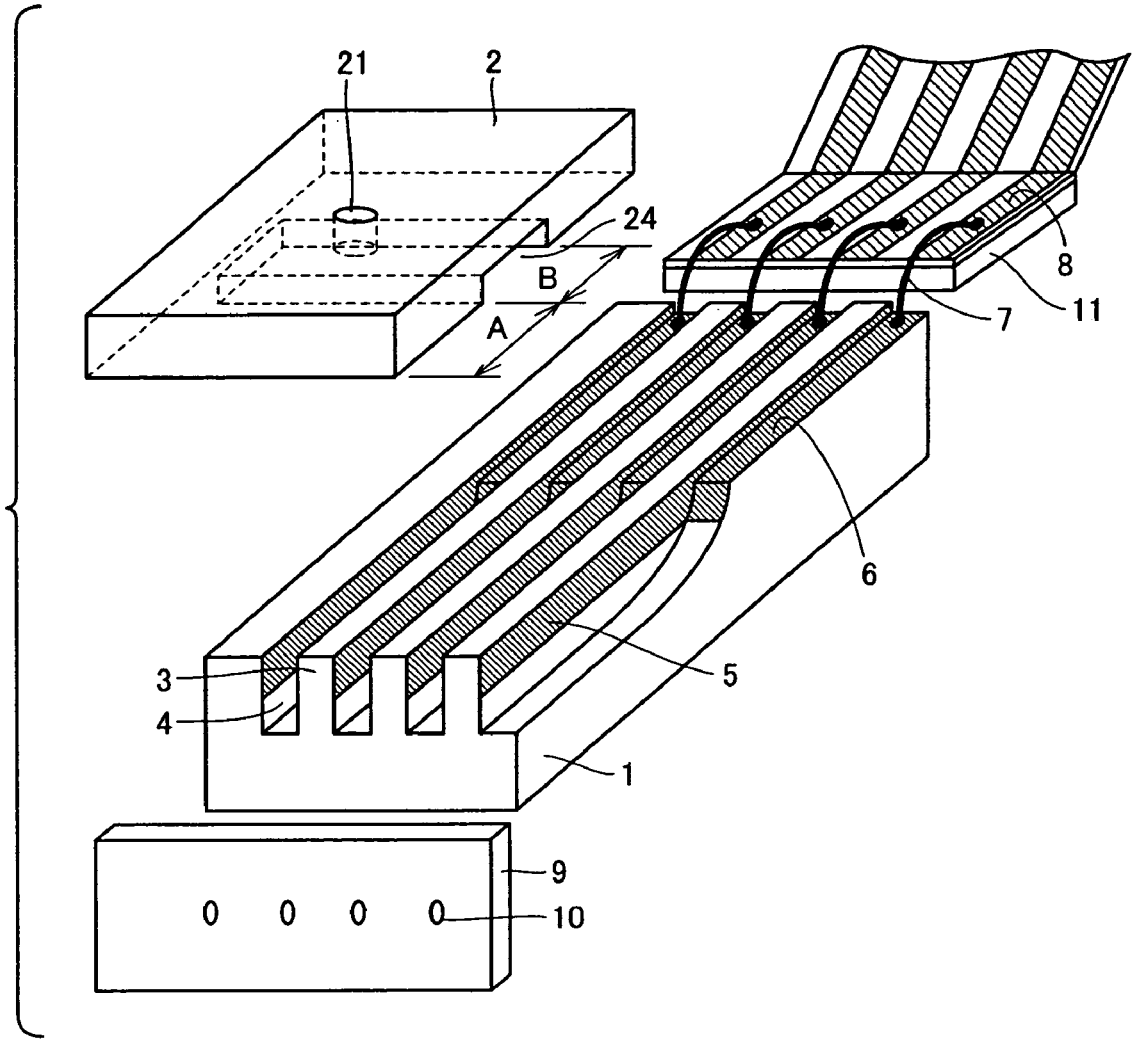
FIG.12 PRIOR ART
FIGS. 12 and 13 are exploded perspective views of first and second conventional ink jet heads.

Referring to FIGS. 10, 11A and 11B, the structure of an ink jet head of a fifth embodiment of the invention will be described. It has basically the same structure as the ink jet head of FIG. 4 except for the shape of beam 25. Specifically, the front surface of beam 25 (the side nozzle plate 9) is inclined toward cover 2. That is, beam 25 has a slope 25*a* in its front, resulting in a beam 25 that is generally trapezoidal as seen in the cross section of FIG. 10.

In FIG. 10, beam 25 protrudes toward the front with respect to the top surface of conductive resin 26. In order to ensure that ink may be prevented from settling below this protrusion, the bottom surface of beam 25 has a length that is equal to that of the top surface of conductive resin 26 as shown in FIG. 11A, or is smaller than that of the top surface of conductive resin 26 as in FIG. 11B.

Since the front surface of beam 25 is slope 25*a*, ink can flow smoothly at corner 34 in FIG. 10, preventing air bubbles from remaining at corners 34. This provides a stable ejection of ink.

A projection on the cover and a beam bonded upon the base have been illustrated in the embodiments described above to exemplify the pressing means for pressing the top of the conductive resin plugging each of the channel grooves at the rear end of an ink jet head, although other pressing means may be possible. For example, instead of a projection on the cover, a member separated from the cover may be interposed between the cover and the base to be fixed therebetween.

According to the present invention, the conductive resin within each channel groove can be pressed by a pressing means, thereby preventing a movement of the conductive resin within the channel groove. Consequently, during establishing electrical connection of the rear end of the ink jet head to other components via the conductive resin, the conductive resin can be prevented from moving away, thereby ensuring electrical connection. Particularly, the structure allowing electrical connection to the circuit board via an anisotropic conductor film requires, during assembly, the step of pinching the film between the rear end of the ink jet head and the circuit board to press it therebetween. The conductive resin within each channel may now be pressed by the pressing means to prevent the conductive resin from moving away when the anisotropic film is pressed, and to apply a sufficient pressure to the film, ensuring electrical connection.

The disclosed embodiments above are by way of illustration and example only and are not by way of limitation. The scope of the present invention is set forth by the claims rather than the above description and includes all the modifications within the spirit and scope equivalent to those of the claims.

INDUSTRIAL APPLICABILITY

The present invention is applicable to an ink jet head mounted on an ink jet printer or the like.

The invention claimed is:

1. An ink jet head comprising:

a base having a front end, a rear end, and a plurality of channel grooves separated by channel walls including a piezoelectric material, said channel grooves extending to said rear end;

a cover placed on said base so as to be in contact therewith and opposite to a face of said base having said plurality of channel grooves;

an electrode placed on at least part of an inner surface of each of said channel grooves;

a conductive resin plugging said channel grooves at said rear end, said conductive resin being electrically connected with said electrodes; and pressing means for pressing a top of said conductive resin at said rear end.

2. The ink jet head according to claim 1, further comprising an anisotropic conductive film in contact with said rear end of said base, and a circuit board in contact with said rear end via said anisotropic conductive film.

3. The ink jet head according to claim 1, wherein said pressing means is a projection provided on said cover.

4. The ink jet head according to claim 3, wherein said plurality of channel grooves are disposed with a given channel groove pitch, and said projection is disposed as a plurality of projections with the same pitch as said channel groove pitch.

5. The ink jet head according to claim 3, wherein said plurality of channel grooves are disposed with a given channel groove pitch, said projection has a tip surface bonded to the top of said conductive resin and a top surface of said channel wall , and said tip surface has a length in the direction perpendicular to the longitudinal direction of said channel grooves larger than the width of one of said channel grooves and smaller than said channel groove pitch.

6. The ink jet head according to claim 3, wherein said plurality of channel grooves are disposed with a given channel groove pitch, and said projection is provided as a plurality of projections with a pitch determined by multiplying said channel groove pitch by an integer.

7. The ink jet head according to claim 3, wherein said plurality of channel grooves are disposed with a given channel groove pitch, and said projection has a tip surface bonded to the top of said conductive resin and a top surface of said channel wall , and said tip surface has a length in the direction perpendicular to the longitudinal direction of said channel grooves larger than the sum of (i) the pitch at which said plurality of channel grooves are disposed and (ii) the width of one channel groove, and smaller than double the pitch of said plurality of channel grooves.

8. The ink jet head according to claim 3, wherein said projection is inclined toward said base in its side facing said front end.

9. The ink jet head according to claim 1, wherein said pressing means is a beam fixed upon said base.

10. The ink jet head according to claim 9, wherein said beam is inclined toward said cover at its side facing said front end.

11. The ink jet head according to claim 9, wherein said beam is made of a material identical with that of said base.

12. The ink jet head according to claim 9, wherein said beam has a coefficient of linear expansion smaller than that of said base.

* * * * *